US011769467B2

(12) United States Patent
Liu et al.

(10) Patent No.: US 11,769,467 B2
(45) Date of Patent: Sep. 26, 2023

(54) TIMING CONTROLLER, DISPLAY DEVICE, AND SIGNAL ADJUSTMENT METHOD

(71) Applicants: Hefei Xinsheng Optoelectronics Technology Co., Ltd., Anhui (CN); BOE Technology Group Co., Ltd., Beijing (CN)

(72) Inventors: Yuanyuan Liu, Beijing (CN); Xuanxuan Qiao, Beijing (CN); Shuai Liu, Beijing (CN); Xianfeng Yuan, Beijing (CN); Zejun Chen, Beijing (CN); Jianjun Wang, Beijing (CN); Zhenzhou Xing, Beijing (CN)

(73) Assignees: HEFEI XINSHENG OPTOELECTRONICS TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 192 days.

(21) Appl. No.: 17/424,132

(22) PCT Filed: Jan. 11, 2021

(86) PCT No.: PCT/CN2021/071103
§ 371 (c)(1),
(2) Date: Jul. 19, 2021

(87) PCT Pub. No.: WO2021/143648
PCT Pub. Date: Jul. 22, 2021

(65) Prior Publication Data

US 2023/0162705 A1 May 25, 2023

(30) Foreign Application Priority Data

Jan. 13, 2020 (CN) ..... 202010032632.1

(51) Int. Cl.
*G09G 5/00* (2006.01)
*G09G 5/18* (2006.01)
*G09G 3/20* (2006.01)

(52) U.S. Cl.
CPC ..... *G09G 5/18* (2013.01); *G09G 3/2022* (2013.01); *G09G 2310/08* (2013.01)

(58) Field of Classification Search
CPC ..... G09G 3/2018; G09G 3/2022; G09G 5/00; G09G 5/18; G09G 2310/08; G09G 2370/00
See application file for complete search history.

(56) References Cited

U.S. PATENT DOCUMENTS 4,491,808 A * 1/1985 Saito ..... H04L 25/03133 375/232
2006/0203830 A1* 9/2006 Doi ..... G01R 31/31716 714/E11.207

(Continued)

FOREIGN PATENT DOCUMENTS

CN 1838095 A 9/2006
CN 106098017 A 11/2016

(Continued)

OTHER PUBLICATIONS

CN202010032632.1 first office action and search report, 24 pages, dated Feb. 10, 2021.

(Continued)

*Primary Examiner* — Joe H Cheng
(74) *Attorney, Agent, or Firm* — IPro, PLLC

(57) ABSTRACT

A timing controller includes a receiving circuit, a timing control circuit, and a plurality of insertion loss circuits. The receiving circuit is configured to receive N frames of signals. The timing control circuit is configured to: detect a bit error rate of an $(M-1)^{th}$-frame signal in a blanking interval of an $M^{th}$-frame signal; adjust a swing of the $(M-1)^{th}$-frame signal (Continued)

according to a target swing value corresponding to the bit error rate of the (M-1)$^{th}$-frame signal; and select the corresponding insertion loss circuit according to the target swing value corresponding to the bit error rate of the (M-1)$^{th}$-frame signal, wherein M and N are both positive integers, and M is greater than 1 and less than or equal to N. The present disclosure is applied to signal adjustment of the timing controller.

18 Claims, 5 Drawing Sheets

(56) References Cited

U.S. PATENT DOCUMENTS

2007/0030062 A1* 2/2007 Hibino ..... H04B 1/18 330/10
2007/0273631 A1 11/2007 Su et al.
2010/0253851 A1* 10/2010 Itou ..... H04B 1/525 348/E5.078
2012/0166896 A1* 6/2012 Oh ..... G09G 5/18 714/704
2015/0098678 A1* 4/2015 Miglani ..... G02B 6/3512 385/17
2016/0125782 A1* 5/2016 Park ..... G09G 3/3291 345/691
2016/0217759 A1* 7/2016 Morita ..... G09G 3/20
2016/0372084 A1* 12/2016 Wang ..... G09G 3/20
2017/0193922 A1* 7/2017 Pyeon ..... G09G 3/3266
2018/0308440 A1 10/2018 Huang
2018/0375483 A1* 12/2018 Balteanu ..... H03F 1/0238
2019/0296740 A1 9/2019 Lin
2019/0340968 A1* 11/2019 Huang ..... G09G 5/008
2020/0135082 A1 4/2020 Chen et al.
2020/0350866 A1* 11/2020 Pehlke ..... H04B 17/318
2021/0218370 A1* 7/2021 Balteanu ..... H04B 1/3827

FOREIGN PATENT DOCUMENTS

CN 108898986 A 11/2018
CN 109192127 A 1/2019
CN 110299162 A 10/2019
CN 111179804 A 5/2020
DE 102011087682 B3 * 5/2013 ..... H04B 1/1036

OTHER PUBLICATIONS

CN202010032632.1 second office action, 20 pages, dated Sep. 8, 2021.

* cited by examiner

TIMING CONTROLLER, DISPLAY DEVICE, AND SIGNAL ADJUSTMENT METHOD

This application is a National Stage filed under 35 U.S.C. 371 filed on Jan. 11, 2021 which claims priority to Chinese Patent Application No. CN202010032632.1, filed on Jan. 13, 2020, the entire contents of which are incorporated herein by reference.

TECHNICAL FIELD

The present disclosure generally relates to the field of display technologies, and more particularly, to a timing controller, a display device, and a signal adjustment method.

BACKGROUND

When display panels display pictures, front-end systems are needed to provide input signals, such as RGB (red, green and blue) signals, LVDS (Low-Voltage Differential Signaling) signals, EDP (Embedded Display Port) signals, etc. These input signals include RGB grayscale data signals, control signals, clock signals, etc. Quality of these input signals determines display quality of the display panels.

The input signals provided by the front-end systems are influenced by the following three factors: the quality of the signals when they are generated; resistance and capacitance in transmission lines of the input signals; and external electromagnetic fields. There are many factors having negative effects on the quality of the input signals. Once the quality of the input signals deteriorates, this may directly cause problems such as color cast and flickering of screens. Therefore, it is of great importance to improve the quality of the input signals of the display panels.

SUMMARY

To achieve the above objective, embodiments of the present disclosure adopt following technical solutions.

In one aspect, a timing controller is provided, which includes a receiving circuit, a timing control circuit, and a plurality of insertion loss circuits. The receiving circuit and the insertion loss circuit are respectively connected to the timing control circuit.

The receiving circuit is configured to receive N frames of signals.

The timing control circuit is configured to:

detect a bit error rate of an $(M-1)^{th}$-frame signal in a blanking interval of an $M^{th}$-frame signal;

adjust a swing of the $(M-1)^{th}$-frame signal according to a target swing value corresponding to the bit error rate of the $(M-1)^{th}$-frame signal;

select the corresponding insertion loss circuit according to the target swing value corresponding to the bit error rate of the $(M-1)^{th}$-frame signal to consume energy generated when adjusting the swing of the $(M-1)^{th}$-frame signal;

wherein, M and N are both positive integers, and M is greater than 1 and less than or equal to N.

Optionally, the adjusting a swing of the $(M-1)^{th}$-frame signal according to a target swing value corresponding to the bit error rate of the $(M-1)^{th}$-frame signal includes:

determining a bit error rate interval where the bit error rate of the $(M-1)^{th}$-frame signal belongs; and adjusting the swing of the $(M-1)^{th}$-frame signal according to a corresponding relationship between the bit error rate interval and the target swing value.

Optionally, the plurality of insertion loss circuits are divided into a plurality of groups of insertion loss units, and each group of the insertion loss units include a first insertion loss circuit and a second insertion loss circuit. The first insertion loss circuit is configured to consume a signal having a first frequency, and the second insertion loss circuit is configured to consume a signal having a second frequency, wherein the first frequency is smaller than the second frequency.

Optionally, the target swing value is corresponding to the insertion loss units one to one.

Optionally, in the each group of the insertion loss units, the first insertion loss circuit includes a capacitor, a first switch, a first ground terminal, and a second ground terminal. Two terminals of the capacitor are respectively connected to the first ground terminal and a first terminal of the first switch, and a second terminal of the first switch is connected to the second ground terminal; and the second insertion loss circuit includes a bead, a second switch, a third ground terminal, and a fourth ground terminal. Two terminals of the bead are respectively connected to the third ground terminal and a first terminal of the second switch, and a second terminal of the second switch is connected to the fourth ground terminal.

Optionally, the first ground terminals of the plurality of first insertion loss circuits and the third ground terminals of the plurality of second insertion loss circuits are the same ground terminals, and the second ground terminals of the plurality of first insertion loss circuits and the fourth ground terminals of the plurality of second insertion loss circuits are the same ground terminals.

Optionally, the adjusting the swing of the $(M-1)^{th}$-frame signal according to a corresponding relationship between the bit error rate interval and the target swing value in a swing regulation table includes:

determining, by the timing control circuit according to the corresponding relationship between the bit error rate interval and the target swing value in the swing regulation table, the target swing value corresponding to the bit error rate of the $(M-1)^{th}$-frame signal; and adjusting a swing value of the $(M-1)^{th}$-frame signal as the target swing value corresponding to the bit error rate of the $(M-1)^{th}$-frame signal.

Optionally, the relationship between the bit error rate interval and the target swing value is stored in the swing regulation table.

Optionally, the timing control circuit is also configured to:

store the swing regulation table before the blanking interval of a first-frame signal, wherein the swing regulation table includes a plurality of bit error rate intervals, a plurality of target swing values, and the corresponding relationship between the bit error rate interval and the target swing value.

In another aspect, a display device is provided, which includes the above timing controller.

In still another aspect, there is provided a signal adjustment method applied to the timing controller. The timing controller includes a receiving circuit and a plurality of insertion loss circuits, wherein the receiving circuit is configured to receive N frames of signals. The method includes:

detecting a bit error rate of an $(M-1)^{th}$-frame signal in a blanking interval of an $M^{th}$-frame signal;

adjusting a swing of the $(M-1)^{th}$-frame signal according to a target swing value corresponding to the bit error rate of the $(M-1)^{th}$-frame signal;

selecting the corresponding insertion loss circuit according to the target swing value corresponding to the bit error rate of the $(M-1)^{th}$-frame signal to consume energy generated when adjusting the swing of the $(M-1)^{th}$-frame signal;

wherein, M and N are both positive integers, and M is greater than 1 and less than N.

Optionally, the adjusting a swing of the $(M-1)^{th}$-frame signal according to a target swing value corresponding to the bit error rate of the $(M-1)^{th}$-frame signal includes:

determining a bit error rate interval where the bit error rate of the $(M-1)^{th}$-frame signal belongs; and adjusting the swing of the $(M-1)^{th}$-frame signal according to a corresponding relationship between the bit error rate interval and the target swing value.

Optionally, the adjusting the swing of the $(M-1)^{th}$-frame signal according to a corresponding relationship between the bit error rate interval and the target swing value in the swing regulation table includes:

determining the target swing value corresponding to the bit error rate of the $(M-1)^{th}$-frame signal according to the corresponding relationship between the bit error rate interval and the target swing value in the swing regulation table; and adjusting a swing value of the $(M-1)^{th}$-frame signal as the target swing value corresponding to the bit error rate of the $(M-1)^{th}$-frame signal.

Optionally, before the blanking interval of a first-frame signal, the method further includes:

storing the swing regulation table, wherein the swing regulation table includes a plurality of bit error rate intervals, a plurality of target swing values, and the corresponding relationship between the bit error rate interval and the target swing value.

Optionally, the blanking interval of the $M^{th}$-frame signal includes an initial interval, an intermediate interval, and an end interval;

the detecting a bit error rate of an $(M-1)^{th}$-frame signal in a blanking interval of an $M^{th}$-frame signal includes:

detecting the bit error rate of the $(M-1)^{th}$-frame signal in the intermediate interval of the blanking interval of the $M^{th}$-frame signal.

In still another aspect, there is disclosed a non-volatile computer-readable storage medium, which includes a computer program. The computer program is executable by an electronic apparatus, whereby the electronic apparatus is configured to perform the aforementioned signal adjustment method.

In still another aspect, there is disclosed a computer program product, which includes a computer program. The computer program is executable by an electronic apparatus, whereby the electronic apparatus is configured to perform the aforementioned signal adjustment method.

The above description is merely an overview of the technical solutions of the present disclosure. In order to more apparently understand the technical means of the present disclosure to implement in accordance with the contents of specification, and to more readily understand above and other objectives, features and advantages of the present disclosure, specific embodiments of the present disclosure are provided hereinafter.

BRIEF DESCRIPTION OF THE DRAWINGS

To describe the technical solutions of the embodiments of the present disclosure or that of the prior art more clearly, the accompanying drawings required for describing the embodiments or the prior art will be briefly introduced below. Apparently, the accompanying drawings in the following description are merely some embodiments of the present disclosure. To those of ordinary skills in the art, other accompanying drawings may also be derived from these accompanying drawings without creative efforts.

DETAILED DESCRIPTION

Technical solutions in the embodiments of the present disclosure will be described clearly and completely below, in conjunction with the accompanying drawings in the embodiments of the present disclosure. Apparently, the described embodiments are some but not all of the embodiments of the present disclosure. All other embodiments obtained by persons of ordinary skill in the art based on the embodiments of the present disclosure without creative efforts shall fall within the protection scope of the present disclosure.

In the embodiments of the present disclosure, "a plurality of" refers to two or more, unless otherwise expressly specified.

Figure 1:
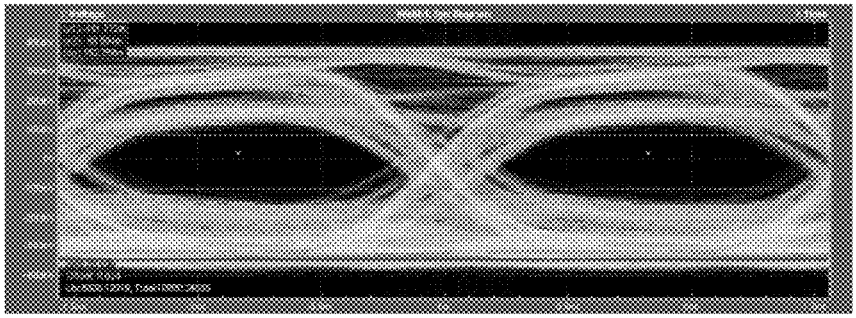
FIG. 1 is an eye diagram of an input signal provided in the related technologies.
Figure 2:
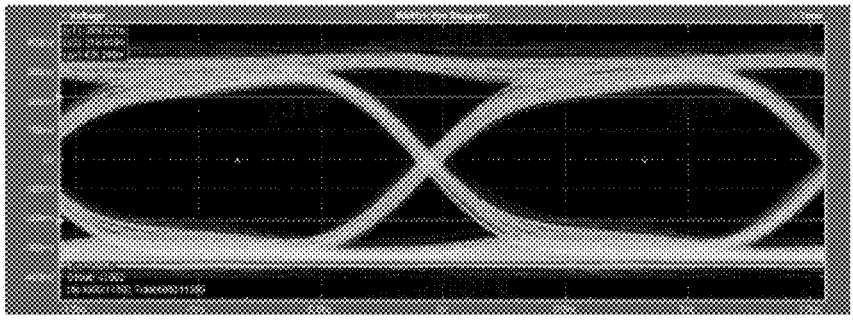
FIG. 2 is an eye diagram of another input signal provided in the related technologies.

A method for improving quality of an input signal in the related technologies is as below. After receiving the input signal transmitted by a front-end system, a control chip TCON of a display panel adjusts a swing of the signal (i.e., the signal swing), which can make fluctuation of the signal more obvious, such that it is easier to obtain effective signal output. Referring to FIG. 1, in an eye diagram of the original input signal, an eye height is about 182 mV. After increasing the swing of the input signal as shown in FIG. 1, the eye diagram of this signal is as shown in FIG. 2, wherein the eye height is about 426 mV, which is increased by about 240 mV compared with the original eye height. The signal quality is improved, such that the display panel is easier to obtain a valid signal from signals as shown in FIG. 2.

However, after the signal swing is increased, the signal is enhanced, and electromagnetic compatibility (EMC) of the display panel is increased accordingly, which not only causes electromagnetic interference to peripheral electronic products, but also is more susceptible to other electronic products.

The embodiments of the present disclosure provide a timing controller, a display device, and a signal adjustment method. The timing controller can improve the quality of the input signal while reducing the EMC interference caused by enhancing the signal.

Figure 3:
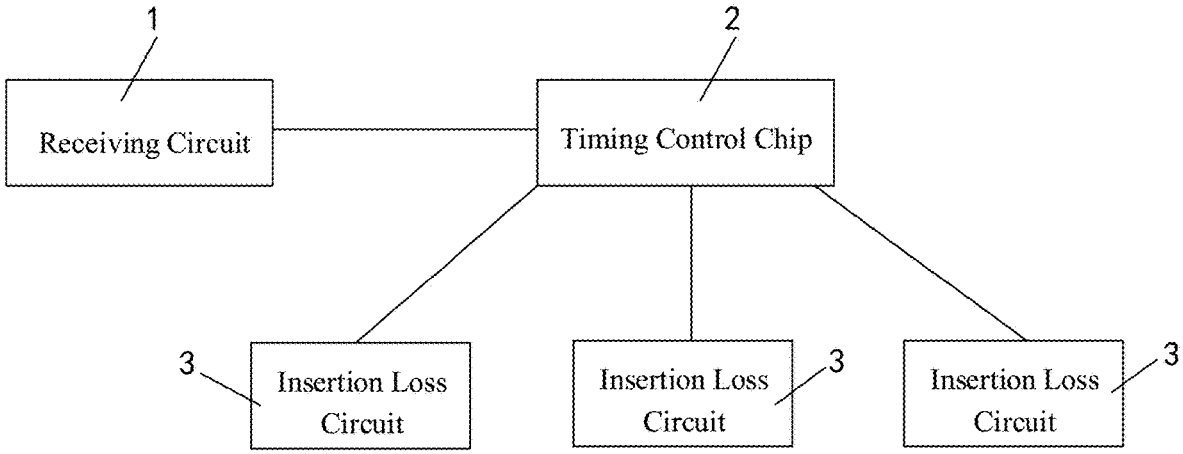
FIG. 3 is a schematic structural diagram of a timing controller according to an embodiment of the present disclosure.

The embodiments of the present disclosure provide a timing controller. With reference to FIG. 3, the timing controller includes a receiving circuit 1, a timing control circuit 2, and a plurality of insertion loss circuits 3. The receiving circuit 1 and the insertion loss circuit 3 are respectively connected to the timing control circuit 2.

The receiving circuit is configured to receive N frames of signals.

In one embodiment, the timing control circuit is configured to:

detect a bit error rate of an $(M-1)^{th}$-frame signal in a blanking interval of an $M^{th}$-frame signal;

adjust a swing of the $(M-1)^{th}$-frame signal according to a target swing value corresponding to the bit error rate of the $(M-1)^{th}$-frame signal; and select the corresponding insertion loss circuit according to the target swing value corresponding to the bit error rate of the $(M-1)^{th}$-frame signal to consume energy generated when adjusting the swing of the $(M-1)^{th}$-frame signal, wherein M and N are both positive integers, and M is greater than 1 and less than or equal to N.

Optionally, the operation of adjusting a swing of the $(M-1)^{th}$-frame signal according to a target swing value corresponding to the bit error rate of the $(M-1)^{th}$-frame signal may include:

determining a bit error rate interval where the bit error rate of the $(M-1)^{th}$-frame signal belongs in a prestored swing regulation table; and adjusting the swing of the $(M-1)^{th}$-frame signal according to a corresponding relationship between the bit error rate interval and the target swing value in the swing regulation table.

The above-mentioned receiving circuit may include an interface, and a type of the interface is not limited, which may be determined according to the type of the signal outputted from the front-end system.

The timing control circuit may be a circuit printed on a circuit board by means of printing and so on, or a timing control chip, etc. The type of the timing control chip is not limited, which may be a chip such as a single-chip microcomputer, Advanced RISC Machines (ARM) or a field programmable gate array (FPGA), and may be determined according to actual design requirements.

The specific structures and number of the above-mentioned insertion loss circuits are not limited, as long as effects of consuming signal energy can be satisfied. In FIG. 3, it is drawn by taking an example where the timing controller includes three insertion loss circuits.

Figure 4:
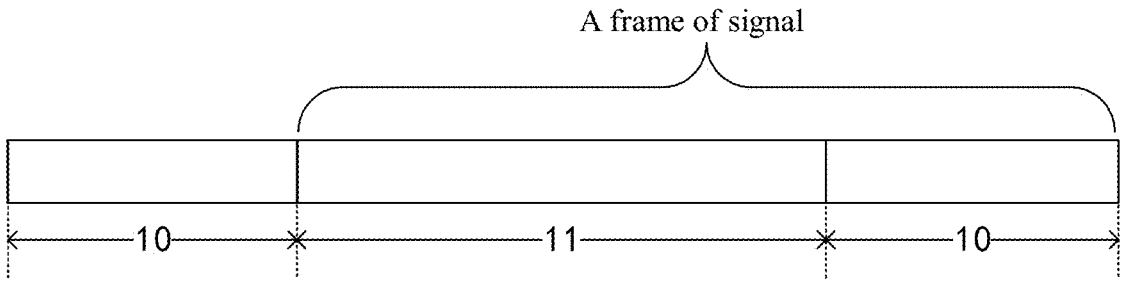
FIG. 4 is a schematic diagram of a signal according to an embodiment of the present disclosure.
Figure 5:
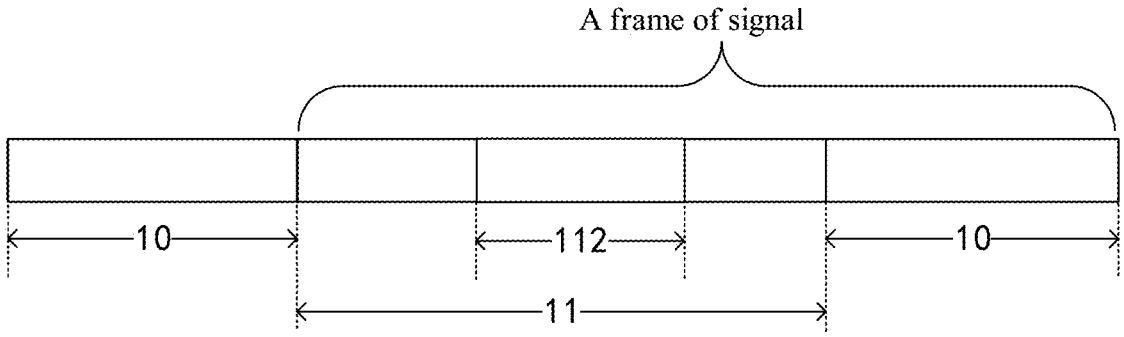
FIG. 5 is a schematic diagram of another signal according to an embodiment of the present disclosure.

It is to be noted that referring to FIG. 4, taking a frame frequency as a time-sharing point, a frame of signal includes an active zone 10 and a blanking zone 11. The active zone corresponds to valid time of the signal, and the blanking zone corresponds to preparation time of the signal. The above timing controller is applied to the display device. The active zone corresponds to a phase of displaying a picture, and the blanking zone corresponds to a phase of not displaying the picture (time corresponding to the blanking zone is very short and it is difficult for the human eye to feel). The aforementioned blanking interval of the $M^{th}$-frame signal corresponds to the blanking zone of the $M^{th}$-frame signal. Referring to FIG. 5, in the present disclosure, a bit error rate (BER) detection zone 112 is added to the blanking zone 11. That is, the bit error rate of the $(M-1)^{th}$-frame signal is detected during the blanking interval of the $M^{th}$-frame signal.

The above-mentioned swing regulation table may be pre-stored in the timing control circuit, and specific contents of the bit error rate interval and the target swing value in the table may be determined according to actual situations.

The embodiments of the present disclosure provide a timing controller (TCON). While adjusting a signal swing, the timing controller can consume, by means of an insertion loss circuit, energy generated when adjusting the signal swing. Therefore, the timing controller can improve the quality of the input signal while reducing the EMC interference caused by enhancing the signal.

Optionally, all the insertion loss circuits are divided into a plurality of groups of insertion loss units, and each group of the insertion loss units include a first insertion loss circuit and a second insertion loss circuit. The first insertion loss circuit is configured to consume a signal having a first frequency, and the second insertion loss circuit is configured to consume a signal having a second frequency, wherein the first frequency is smaller than the second frequency.

Signals may be classified into high-frequency signals and low-frequency signals. The energy of the low-frequency signals can be consumed by means of the first insertion loss circuit, and the energy of the high-frequency signals can be consumed by means of the second insertion loss circuit. In this way, consumption of the energy of the signals can be maximized, and the EMC energy interference can be further reduced.

Optionally, the target swing value corresponds to the insertion loss unit one to one in the swing regulation table. That is, the target swing value in the swing regulation table, the first insertion loss circuit and the second insertion loss in the same insertion loss unit constitute a one-to-one correspondence relationship, which can reduce design difficulty. In other alternative embodiments, the target swing value in the swing regulation table and the insertion loss unit also may not constitute the one-to-one correspondence relationship.

Figure 6:
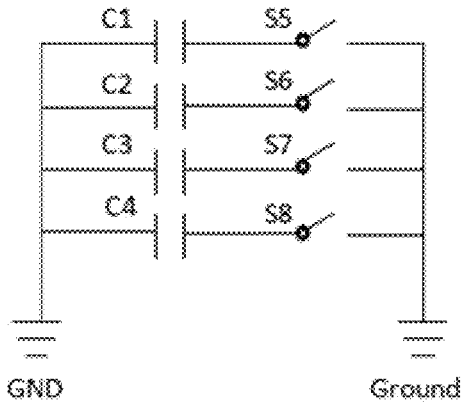
FIG. 6 is a schematic diagram of a first insertion loss circuit according to an embodiment of the present disclosure.

Optionally, in the each group of the insertion loss units, as shown in FIG. 6, the first insertion loss circuit includes: a capacitor C1, a first switch S5, a first ground terminal GND, and a second ground terminal Ground. Two terminals of the capacitor C1 are respectively connected to the first ground terminal GND and a first terminal (not marked in FIG. 6) of the first switch S5, and a second terminal (not marked in FIG. 6) of the first switch S5 is connected to the second ground terminal Ground.

Figure 7:
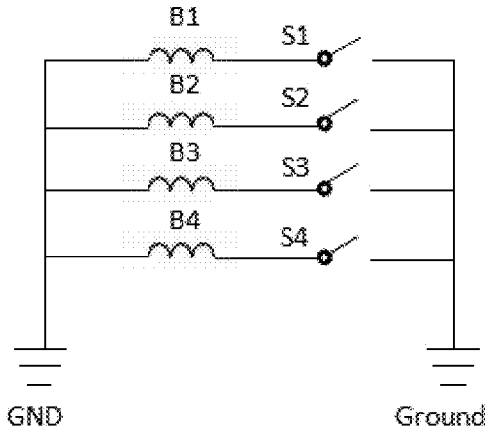
FIG. 7 is a schematic diagram of a second insertion loss circuit according to an embodiment of the present disclosure.

With reference to FIG. 7, the second insertion loss circuit includes a bead B1, a second switch S1, a third ground terminal GND, and a fourth ground terminal Ground. Two terminals of the bead B1 are respectively connected to the third ground terminal GND and a first terminal (not marked in FIG. 7) of the second switch S1, and a second terminal (not marked in FIG. 7) of the second switch S1 is connected to the fourth ground terminal Ground.

It is to be noted that in FIG. 6 and FIG. 7, it is drawn by respectively taking four first insertion loss circuits and four second insertion loss circuits as examples, and in this case, the corresponding swing regulation table may be as shown in Table I.

TABLE I

| Bit error rate interval | Target swing value |
|---|---|
| ≤BER1 | Swing1 |
| BER1-BER2 | Swing2 |
| BER2-BER3 | Swing3 |
| ≥BER3 | Swing4 |

For ease of description, the capacitors in the four first insertion loss circuits in FIG. 6 are respectively marked as C1, C2, C3, and C4; and the first switches respectively corresponding to C1, C2, C3 and C4 are respectively marked as S5, S6, S7, and S8. The beads in the four second insertion loss circuits in FIG. 7 are respectively marked as B1, B2, B3, and B4; and the second switches respectively corresponding to B1, B2, B3 and B4 are respectively marked as S1, S2, S3, and S4. The switches S1-S8 here are controlled by the timing control circuit. When the target swing value is Swing1, the switches S1 and S5 are closed to form a Swing1 insertion loss unit. When the target swing value is Swing2, the switches S2 and S6 are closed to form a Swing2 insertion loss unit, and so on. Values of the beads and the capacitors in the insertion loss units of each swing are determined by simulation and debugging in advance.

With reference to FIG. 6 and FIG. 7, the first ground terminals of all the first insertion loss circuits and the third ground terminals of all the second insertion loss circuits are the same ground terminals (GND), and the second ground terminals of all the first insertion loss circuits and the fourth ground terminals of all the second insertion loss circuits are the same ground terminals (Ground).

Figure 8:
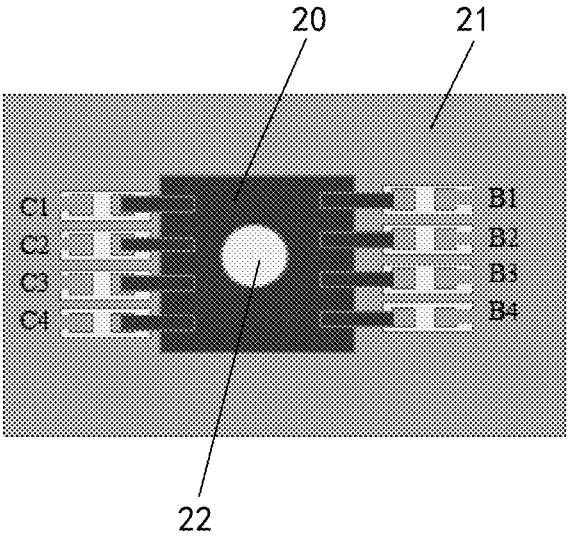
FIG. 8 is a design layout of an insertion loss circuit according to an embodiment of the present disclosure.

Reference may be made to FIG. 8 for layouts in FIG. 6 and FIG. 7. A GND Pad area is represented by 21, wherein GND represents a logic ground of a drive circuit in the timing controller. A Ground Pad area is represented by 20, and is deployed in the form of Plane Shape. The timing controller is applied to a liquid crystal display. Ground may represent a ground area in a backpanel of the liquid crystal display. Pins at one end of B1-B4 and C1-C4 are connected to the Ground Pad 20 in the form of Plane Shape, and pins at the other end thereof are connected to the GND Pad 21 through an analog control switch (not shown in FIG. 8). To improve heat dissipation, the Ground Pad area 20 may be perforated uniformly (not shown in FIG. 8). In FIG. 8, the Ground Pad area 20 may be made of copper sheet and may be fixed by a screw hole 22. In this way, when there is EMC energy, the energy can be consumed through this circuit.

Optionally, to decrease difficulty in adjusting the signal swing, the timing control circuit being configured to adjust the swing of the $(M-1)^{th}$-frame signal according to a corresponding relationship between the bit error rate interval and the target swing value in a swing regulation table includes:

the timing control circuit being configured to:

determine the target swing value corresponding to the bit error rate of the $(M-1)^{th}$-frame signal according to the corresponding relationship between the bit error rate interval and the target swing value in the swing regulation table; and adjust a swing value of the $(M-1)^{th}$-frame signal as the target swing value corresponding to the bit error rate of the $(M-1)^{th}$-frame signal.

Optionally, the timing control circuit is also configured to:

store the swing regulation table before the blanking interval of a first-frame signal, wherein the swing regulation table includes a plurality of bit error rate intervals, a plurality of target swing values, and the corresponding relationship between the bit error rate interval and the target swing value. The swing regulation table may be as shown in Table I. Table I is drawn by taking an example where the swing regulation table includes four bit error rate intervals and four target swing values.

An embodiment of the present disclosure provides a display device, which includes the aforementioned timing controller.

The display device may be a rigid display device or a flexible display device (that is, bendable or foldable). The display device may be, for example, a twisted nematic (TN) liquid crystal display device, a vertical alignment (VA) liquid crystal display device, an in-plane switching (IPS) or advanced super dimension switch (ADS) liquid crystal display device, or an organic light-emitting diode (OLED) display device, and any products or components with display functions such as televisions, digital cameras, mobile phones, and tablet personal computers including these display devices.

An embodiment of the present disclosure provides a display device, which is better in picture display, stronger in resistance to electromagnetic interference, weaker in interference, and better in user experience.

Figure 9:
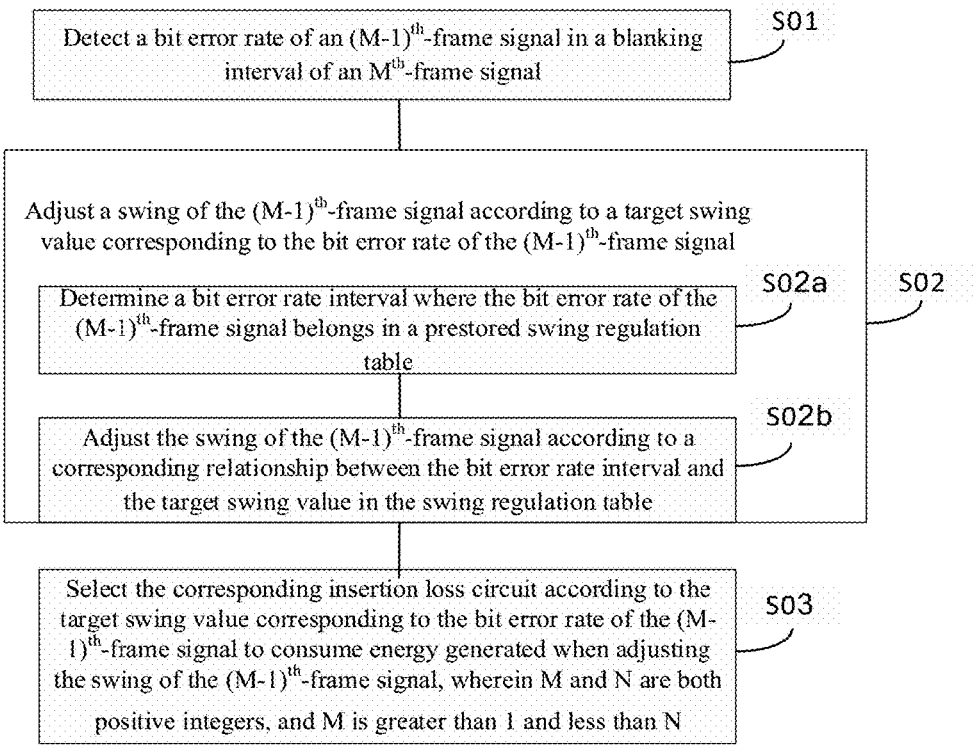
FIG. 9 is a schematic flow diagram of a signal adjustment method according to an embodiment of the present disclosure.

An embodiment of the present disclosure provides a signal adjustment method, which is applied to the aforementioned timing controller. The timing controller includes a receiving circuit and a plurality of insertion loss circuits, wherein the receiving circuit is configured to receive N frames of signals. With reference to FIG. 9, the method includes:

Step S01: detecting a bit error rate of an $(M-1)^{th}$-frame signal in a blanking interval of an $M^{th}$-frame signal;

Step S02: adjusting a swing of the $(M-1)^{th}$-frame signal according to a target swing value corresponding to the bit error rate of the $(M-1)^{th}$-frame signal; and Step S03: selecting the corresponding insertion loss circuit according to the target swing value corresponding to the bit error rate of the $(M-1)^{th}$-frame signal to consume energy generated when adjusting the swing of the $(M-1)^{th}$-frame signal, wherein M and N are both positive integers, and M is greater than 1 and less than N.

It is to be noted that all the above Steps S01-S03 are completed in the blanking interval of the $M^{th}$-frame signal, which has no negative effect on normal display.

Optionally, the Step S02 of adjusting a swing of the $(M-1)^{th}$-frame signal according to a target swing value corresponding to the bit error rate of the $(M-1)^{th}$-frame signal may include:

Step S02*a*: determining a bit error rate interval where the bit error rate of the $(M-1)^{th}$-frame signal belongs in a prestored swing regulation table; and Step S02*b*: adjusting the swing of the $(M-1)^{th}$-frame signal according to a corresponding relationship between the bit error rate interval and the target swing value in the swing regulation table.

An embodiment of the present disclosure provides a signal adjustment method. By using this signal adjustment method, while adjusting a signal swing, energy generated when adjusting the signal swing can be consumed by means of an insertion loss circuit. Therefore, while improving quality of an input signal, EMC interferences caused by enhancing the signal can be reduced.

Optionally, the Step S02*b* of adjusting the swing of the $(M-1)^{th}$-frame signal according to a corresponding relationship between the bit error rate interval and the target swing value in the swing regulation table includes:

determining the target swing value corresponding to the bit error rate of the $(M-1)^{th}$-frame signal according to the corresponding relationship between the bit error rate interval and the target swing value in the swing regulation table; and adjusting a swing value of the $(M-1)^{th}$-frame signal as the target swing value corresponding to the bit error rate of the $(M-1)^{th}$-frame signal.

Optionally, before the blanking interval of a first-frame signal, the method also includes: storing the swing regulation table, wherein the swing regulation table includes a plurality of bit error rate intervals, a plurality of target swing values, and the corresponding relationship between the bit error rate interval and the target swing value.

Optionally, the blanking interval of the $M^{th}$-frame signal includes an initial interval, an intermediate interval, and an end interval.

The detecting a bit error rate of an $(M-1)^{th}$-frame signal in a blanking interval of an $M^{th}$-frame signal includes:

detecting the bit error rate of the $(M-1)^{th}$-frame signal in the intermediate interval of the blanking interval of the $M^{th}$-frame signal.

Other signals may be processed generally in the initial interval and the end interval of the blanking interval. By detecting in the intermediate interval of the blanking interval of the $M^{th}$-frame signal, interactions can be avoided, and accuracy of detection can be improved.

Figure 10:
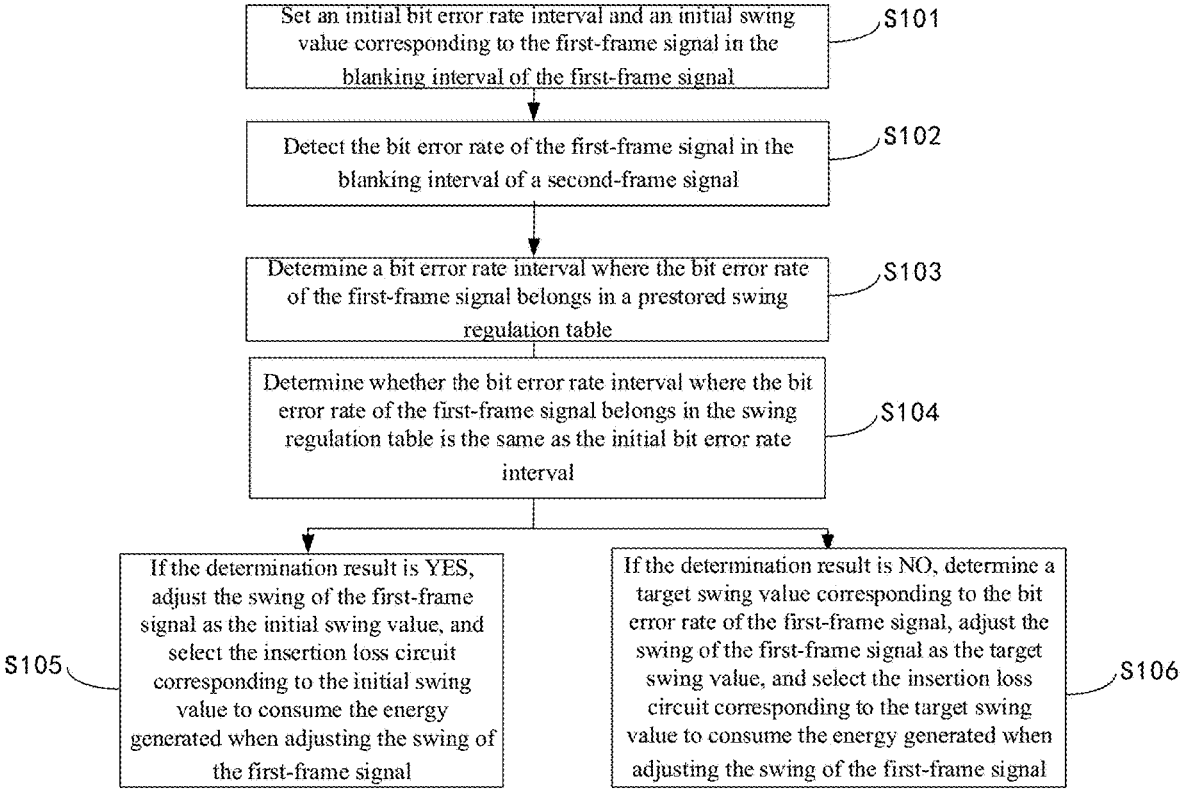
FIG. 10 is a schematic flow diagram of another signal adjustment method according to an embodiment of the present disclosure.

How to adjust the swing of the first-frame signal is described in detail as below. With reference to FIG. 10, this method includes following steps.

Step S101: setting an initial bit error rate interval and an initial swing value corresponding to the first-frame signal in the blanking interval of the first-frame signal.

Step S102: detecting the bit error rate of the first-frame signal in the blanking interval of a second-frame signal.

Step S103: determining a bit error rate interval where the bit error rate of the first-frame signal belongs in a prestored swing regulation table.

Step S104: determining whether the bit error rate interval where the bit error rate of the first-frame signal belongs in the swing regulation table is the same as the initial bit error rate interval.

Step S105: if the determination result is YES, adjusting the swing of the first-frame signal as the initial swing value, and selecting the insertion loss circuit corresponding to the initial swing value to consume the energy generated when adjusting the swing of the first-frame signal.

Step S106: if the determination result is NO, determining a target swing value corresponding to the bit error rate of the first-frame signal, adjusting the swing of the first-frame signal as the target swing value, and selecting the insertion loss circuit corresponding to the target swing value to consume the energy generated when adjusting the swing of the first-frame signal.

After the Step S105 or S106, the next-frame signal (i.e., the second-frame signal) is adjusted, which specifically includes following steps.

Step S201: detecting a bit error rate of the second-frame signal in the blanking interval of a third-frame signal.

Step S202: determining a bit error rate interval where the bit error rate of the second-frame signal belongs in the prestored swing regulation table.

Step S203: determining the target swing value corresponding to the bit error rate of the second-frame signal according to the corresponding relationship between the bit error rate interval and the target swing value in the swing regulation table; and adjusting a swing value of the second-frame signal as the target swing value corresponding to the bit error rate of the second-frame signal.

Step S204: selecting the corresponding insertion loss circuit according to the target swing value corresponding to the bit error rate of the second-frame signal to consume the energy generated when adjusting the swing of the second-frame signal.

In this way, the other frame signals are adjusted until all the frame signals are adjusted. Methods for adjusting from the third-frame signal to a last-frame signal are similar to the method for adjusting the second-frame signal, and thus are not described in detail here. As a self-adaptive signal adjustment method, this signal adjustment method can adjust signal quality in real time and improve picture quality. Furthermore, according to the target swing value of the signal, energy is consumed by using the insertion loss circuit synchronously, such that EMC risks are reduced, interference of a panel is reduced, and capability of resistance to interference of the panel is increased.

Device embodiments set forth above are merely exemplary, wherein units described as detached parts may be or not be detachable physically; parts displayed as units may be or not be physical units, i.e., either located at the same place, or distributed on a plurality of network units. Modules may be selected in part or in whole according to actual needs to achieve objectives of the solution of this embodiment. Those of ordinary skill in the art may comprehend and implement the embodiment without contributing creative effort.

Each of the device embodiments of the present disclosure can be implemented by hardware, or implemented by software modules operating on one or more processors, or implemented by the combination thereof. A person skilled in the art should understand that, in practice, a microprocessor or a digital signal processor (DSP) may be used to realize some or all of the functions of some or all of the parts in the electronic apparatus according to the embodiments of the present disclosure. The present disclosure may further be implemented as apparatus or device program (for example, computer program and computer program product) for performing some or all of the methods as described herein. Such program for implementing the present disclosure may be stored in the computer readable medium, or have a form of one or more signals. Such a signal may be downloaded from the Internet websites, or be provided on a carrier signal, or provided in any other form.

Figure 11:
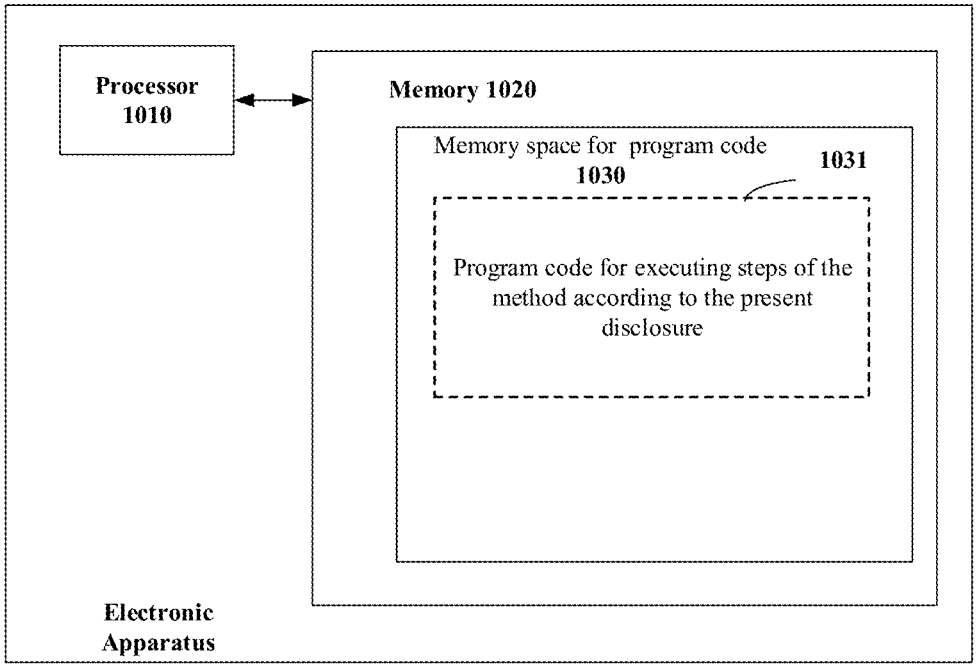
FIG. 11 schematically illustrates a block diagram of an electronic apparatus for performing the method according to the present disclosure.
Figure 12:
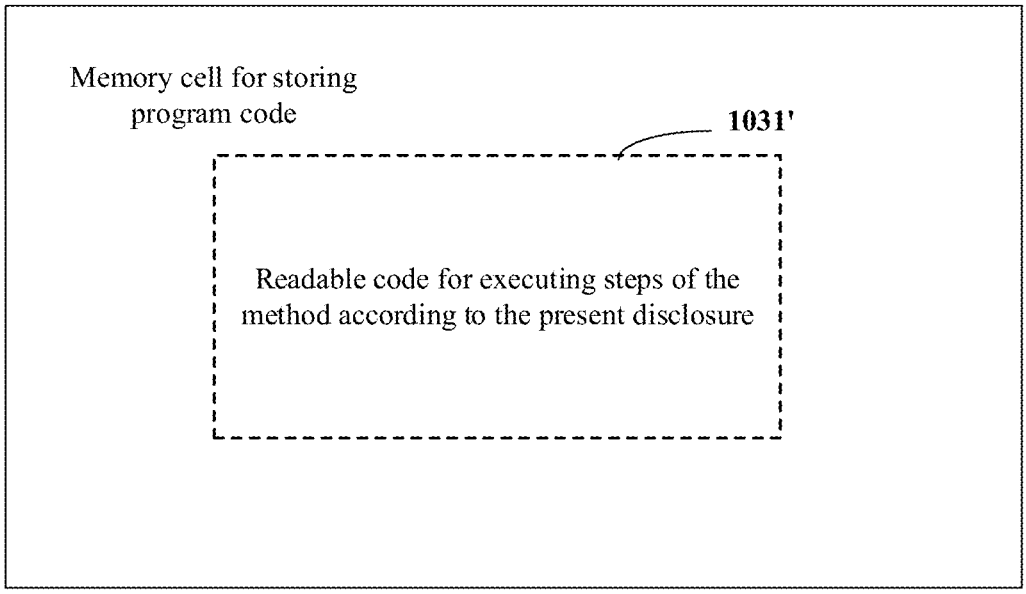
FIG. 12 schematically illustrates a memory cell for maintaining or carrying a computer program code for implementing the method according to the present disclosure.

For example, FIG. 11 illustrates a computing apparatus that may implement the method according to the present disclosure. Traditionally, the electronic apparatus includes a processor 1010 and a computer program product or a computer readable medium in form of a memory 1020. The memory 1020 may be electronic memories such as flash memory, EEPROM (Electrically Erasable Programmable Read-Only Memory), EPROM, hard disk or ROM. The memory 1020 has a memory space 1030 for executing program codes 1031 of any steps in the above methods. For example, the memory space 1030 for program codes may comprise respective program codes 1031 for implementing the respective steps in the method as mentioned above. These program codes may be read from and/or be written into one or more computer program products. These computer program products include program code carriers such as hard disk, compact disk (CD), memory card or floppy disk. These computer program products generally are the portable or stable memory cells as shown in reference FIG. 12. The memory cells may be provided with memory sections, memory spaces, etc., similar to the memory 1020 of the electronic apparatus as shown in FIG. 11. The program codes may be compressed for example in an appropriate form. Generally, the memory cell includes computer readable codes 1031' which can be read for example by processors 1010. When these codes are operated on the electronic apparatus, the electronic apparatus may be caused to perform respective steps in the method as described above.

It is to be noted that reference may be made to the foregoing embodiments for related contents of the timing controller, and thus their detailed descriptions are omitted herein.

"One embodiment", "embodiments" or "one or more embodiments" herein means that particular features, structures or characteristics described in combination with the embodiments are included in at least one embodiment of the present disclosure. Furthermore, it is to be noted that the term "in one embodiment" herein does not necessarily refer to the same embodiment.

Many details are discussed in the specification provided herein. However, it should be understood that the embodiments of the present disclosure can be practiced without these specific details. In some examples, the well-known methods, structures and technologies are not shown in detail so as to avoid an unclear understanding of the description.

The above is merely specific embodiments of the present disclosure, but the protection scope of the present disclosure is not limited thereto. Any variation or substitution easily conceivable to those skilled in the art shall fall into the protection scope of the present disclosure. Therefore, the protection scope of the present disclosure shall be subject to the protection scope of the claims.

The invention claimed is:

1. A timing controller, wherein the timing controller comprises a receiving circuit, a timing control circuit, and a plurality of insertion loss circuits;

the receiving circuit and the insertion loss circuit are respectively connected to the timing control circuit;

the receiving circuit is configured to receive N frames of signals;

the timing control circuit is configured to:

detect a bit error rate of an $(M-1)^{th}$-frame signal in a blanking interval of an Mth-frame signal;

adjust a swing of the $(M-1)^{th}$-frame signal according to a target swing value corresponding to the bit error rate of the $(M-1)^{th}$-frame signal; and select the corresponding insertion loss circuit according to the target swing value corresponding to the bit error rate of the $(M-1)^{th}$-frame signal to consume energy generated when adjusting the swing of the $(M-1)^{th}$-frame signal;

wherein M and N are both positive integers, and M is greater than 1 and less than or equal to N.

2. The timing controller according to claim 1, wherein the adjusting a swing of the $(M-1)^{th}$-frame signal according to a target swing value corresponding to the bit error rate of the $(M-1)^{th}$-frame signal comprises:

determining a bit error rate interval where the bit error rate of the $(M-1)^{th}$-frame signal belongs; and adjusting the swing of the $(M-1)^{th}$-frame signal according to a corresponding relationship between the bit error rate interval and the target swing value.

3. The timing controller according to claim 2, wherein the adjusting the swing of the $(M-1)^{th}$-frame signal according to a corresponding relationship between the bit error rate interval and the target swing value in a swing regulation table comprises:

determining, by the timing control circuit according to the corresponding relationship between the bit error rate interval and the target swing value in the swing regulation table, the target swing value corresponding to the bit error rate of the $(M-1)^{th}$-frame signal; and adjusting a swing value of the $(M-1)^{th}$-frame signal as the target swing value corresponding to the bit error rate of the $(M-1)^{th}$-frame signal.

4. The timing controller according to claim 3, wherein the timing control circuit is further configured to:

store the swing regulation table before the blanking interval of a first-frame signal, wherein the swing regulation table comprises a plurality of bit error rate intervals, a plurality of target swing values, and the corresponding relationship between the bit error rate interval and the target swing value.

5. The timing controller according to claim 2, wherein the relationship between the bit error rate interval and the target swing value is stored in a swing regulation table.

6. The timing controller according to claim 1, wherein the plurality of insertion loss circuits are divided into a plurality of groups of insertion loss units, each group of the insertion loss units comprise a first insertion loss circuit and a second insertion loss circuit, the first insertion loss circuit is configured to consume a signal having a first frequency, and the second insertion loss circuit is configured to consume a signal having a second frequency, wherein the first frequency is smaller than the second frequency.

7. The timing controller according to claim 6, wherein the target swing value is corresponding to the insertion loss units one to one.

8. The timing controller according to claim 6, wherein in the each group of the insertion loss units, the first insertion loss circuit comprises: a capacitor, a first switch, a first ground terminal, and a second ground terminal; two terminals of the capacitor are respectively connected to the first ground terminal and a first terminal of the first switch, and a second terminal of the first switch is connected to the second ground terminal; and the second insertion loss circuit comprises: a bead, a second switch, a third ground terminal, and a fourth ground terminal; and two terminals of the bead are respectively connected to the third ground terminal and a first terminal of the second switch, and a second terminal of the second switch is connected to the fourth ground terminal.

9. The timing controller according to claim 8, wherein the first ground terminals of the plurality of first insertion loss circuits and the third ground terminals of the plurality of second insertion loss circuits are the same ground terminals, and the second ground terminals of the plurality of first insertion loss circuits and the fourth ground terminals of the plurality of second insertion loss circuits are the same ground terminals.

10. A display device, wherein the device comprises the timing controller according to claim 1.

11. A signal adjustment method, applied to the timing controller according to claim 1, the timing controller comprising a receiving circuit and a plurality of insertion loss circuits, the receiving circuit being configured to receive N frames of signals, wherein the method comprises:

detecting a bit error rate of an $(M-1)^{th}$-frame signal in a blanking interval of an $M^{th}$-frame signal;

adjusting a swing of the $(M-1)^{th}$-frame signal according to a target swing value corresponding to the bit error rate of the $(M-1)^{th}$-frame signal; and selecting the corresponding insertion loss circuit according to the target swing value corresponding to the bit error rate of the $(M-1)^{th}$-frame signal to consume energy generated when adjusting the swing of the $(M-1)^{th}$-frame signal;

wherein M and N are both positive integers, and M is greater than 1 and less than N.

12. The signal adjustment method according to claim 11, wherein the adjusting a swing of the $(M-1)^{th}$-frame signal according to a target swing value corresponding to the bit error rate of the $(M-1)^{th}$-frame signal comprises:

determining a bit error rate interval where the bit error rate of the $(M-1)^{th}$-frame signal belongs; and adjusting the swing of the $(M-1)^{th}$-frame signal according to a corresponding relationship between the bit error rate interval and the target swing value.

13. The signal adjustment method according to claim 12, wherein the adjusting the swing of the $(M-1)^{th}$-frame signal according to a corresponding relationship between the bit error rate interval and the target swing value comprises:

determining the target swing value corresponding to the bit error rate of the $(M-1)^{th}$-frame signal according to the corresponding relationship between the bit error rate interval and the target swing value in the swing regulation table; and adjusting a swing value of the $(M-1)^{th}$-frame signal as the target swing value corresponding to the bit error rate of the $(M-1)^{th}$-frame signal.

14. The signal adjustment method according to claim 12, wherein before the blanking interval of a first-frame signal, the method further comprises:

storing the swing regulation table, wherein the swing regulation table comprises a plurality of bit error rate intervals, a plurality of target swing values, and the corresponding relationship between the bit error rate interval and the target swing value.

15. The signal adjustment method according to claim 11, wherein the blanking interval of the $M^{th}$-frame signal comprises an initial interval, an intermediate interval, and an end interval; and the detecting a bit error rate of an $(M-1)^{th}$-frame signal in a blanking interval of an $M^{th}$-frame signal comprises:

detecting the bit error rate of the $(M-1)^{th}$-frame signal in the intermediate interval of the blanking interval of the $M^{th}$-frame signal.

16. A non transitory computer-readable storage medium, comprising a computer program, the computer program is executable by an electronic apparatus, whereby the electronic apparatus is configured to perform the signal adjustment method according to claim 11.

17. A computer program product, comprising a computer program, the computer program is executable by an electronic apparatus, whereby the electronic apparatus is configured to perform the signal adjustment method according to claim 11.

18. An electronic apparatus, wherein the electronic apparatus comprises:

a processor, a memory and a computer program stored on the memory and may be operated on the processor, and when the processor executes the program, the processor implements the signal adjustment method according to claim 11.

* * * * *